United States Patent [19]

Godwin

[11] 4,286,809

[45] Sep. 1, 1981

[54] CHILD-PROOF CABINET CLOSURES

[76] Inventor: Richard H. Godwin, 18 Osborne Rd., Garden City, N.Y. 11535

[21] Appl. No.: 46,862

[22] Filed: Jun. 8, 1979

[51] Int. Cl.[3] ..... E05C 3/14

[52] U.S. Cl. ..... 292/54; 292/DIG. 65

[58] Field of Search ..... 292/DIG. 65, 54

[56] References Cited

U.S. PATENT DOCUMENTS

| | | | |
|---|---|---|---|
| 62,617 | 3/1867 | Dorwart | 292/54 |
| 2,226,072 | 12/1940 | Polack | 292/54 X |
| 2,233,699 | 3/1941 | Gorrell | 292/DIG. 65 X |
| 2,426,399 | 8/1947 | Lipani | 292/54 |
| 2,936,189 | 5/1960 | Pearson | 292/DIG. 65 X |
| 3,666,338 | 5/1972 | Russell | 292/DIG. 65 |
| 3,893,721 | 7/1975 | Upton | 292/DIG. 65 |

*Primary Examiner*—William E. Lyddane

*Attorney, Agent, or Firm*—Eisenman, Allsopp and Strack

[57] ABSTRACT

A number of conveniently manufactured and easily installed fastening devices are disclosed for use with conventional cabinets and enclosures. Each of these devices inherently utilizes the physical fact that a child's hand span is smaller than that of an adult. The devices make it impossible to open an enclosure by individuals having a hand span less than a predetermined length. Each fastening device, or pair of devices, includes a spring-biased latching means that engages a fixed strike plate internal to the enclosure being protected. Latch release means are provided on the outside of the enclosure and these latch means are operable in conjunction with a further release means, both combining to successfully open the enclosure.

2 Claims, 8 Drawing Figures

CHILD-PROOF CABINET CLOSURES

BACKGROUND OF THE INVENTION

1. Field of the Invention

This invention relates to means for preventing children from gaining access to enclosures; more particularly, it relates to fastening devices for installation upon conventional cabinets or enclosures.

2. Description of the Prior Art

The curiosity of children and its potentially dangerous consequences requires foresight and care on the part of all concerned adults. Childhood poisoning ranks prominently among those accidents which constitute the greatest threat to the physical security of the small child. It has been recognized that such accidents can be prevented, or at least reduced in number, by keeping dangerous substances securely stored.

Security from the hands and actions of children differs from that involved when one is considering adults. Distinctions in intelligence, curiosity, and manual dexterity are not truly discriminatory between the adult and the child. On the other hand, one can generally rely upon the fact that children are smaller than adults and have both shorter hand spans and shorter arm reach. This has led to the storage of items on higher shelves for example. One also finds a selfhelp arrangement wherein locks are inserted on cabinets and the keys placed in a remote or secret place.

The inventor's prior U.S. Pat. No. 3,519,299 discusses this problem extensively and discloses a particular type of safety lock for containers wherein the hand span of an adult is required to effect release of a principle catch means while an auxiliary catch release is operated simultaneously. Other devices have been proposed wherein, for example, a plurality of release catches are disposed on a container in such a manner as to require either manual dexterity or hand spans that are beyond the scope of children and yet within the scope of the adult population.

SUMMARY OF THE INVENTION

After considerable testing and development in this field, it is clear that simplicity and adaptability to existing structures is an important feature of any childresistant mechanism that is to be adopted by the public and therefore of wide ranging value in reducing childhood accidents. Locks, either key or combination actuated, are unsatisfactory because they are necessarily cumbersome and often delay actuation in emergency situations. Also, obtrusive devices or devices which require special fabricating techniques on the cabinets are impractical as well as aesthetically undesirable. While all such devices are intended to be opened only by adults, it is necessary to remember that their actuation should be convenient for the adult as well as impossible for children. Still further, the inevitable aging of children and their growth in responsibility makes it desirable that such child-resistant fasteners can be disabled when their owners no longer deem them to be required.

It is an object of the present invention to provide child-resistant fasteners that require no keys, memory codes, or complicated manipulation to effect their release.

Another object of the invention is to provide child-resistant fasteners that are convenient to use, highly effective, and adaptable for employment in a variety of existing structures.

Yet another object of the invention is to provide child-resistant fasteners that are aesthetically attractive, relatively inexpensive, and installable in existing structures or new structures with conventional tools.

Another object of the invention is to provide child-resistant fastening devices that may be conveniently employed in place of conventional fasteners and that may be easily disabled in order to provide what has heretofore been recognized as conventional operation.

In accordance with one embodiment of the invention, a child-resistant fastening device is disclosed for use on a standard cabinet having an outward opening door. A pair of spring actuated latching means is described for mounting on the inner surface of the door, each means being positioned for engagement with catch means secured internally to the body of the cabinet. A release for each catch projects through the door opening in positions separated by an adult hand span; the release means being directly connected to each latch means and being actuable either in the plane of the door or orthogonally thereto. In the preferred embodiments, such doors are further secured by conventional latches so that a second hand is required to pull them open after the aforementioned catches are released.

A complete understanding of the invention, an appreciation of its features, and the manner in which the above objectives are achieved, will be available from the following description that is made in conjunction with the drawings.

DESCRIPTION OF THE PREFERRED EMBODIMENTS

Figure 1:
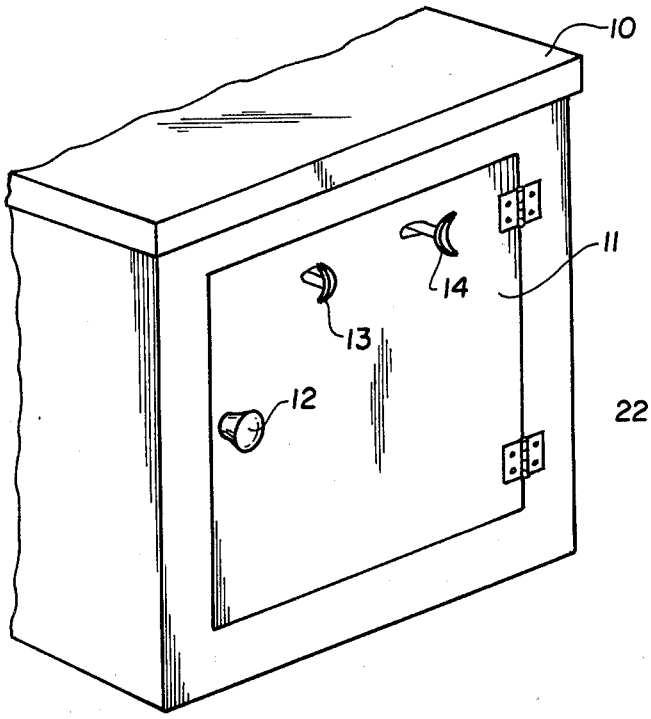
FIG. 1 is an illustrative view of a cabinet having fastening devices of the type contemplated by the invention mounted thereon.

An important feature of the present invention lies in the fact that the various embodiments are suitable for installation on existing cabinet structures. They are specifically designed for ease of installation using only the "home handyman" tools available to average unskilled people. FIG. 1 shows a typical cabinet 10 having a standard type door 11 providing access thereto. The door is hinged at one side and has a friction release catch at the opposing side. Handle 12 is the usual means for opening the door outwardly against the pressure of such a conventional friction catch. The present invention contemplates the use of the conventional handle and release at 12 in addition to a hand-span dependent latching mechanism illustrated by handles 13, 14. These handles are disposed in a position away from handle 12 and are separated from one another by a distance that is greater than a child's hand span, but less than an adult's hand span. Depending upon the particular embodiment of the invention, simultaneously depressing these handles toward the interior of the cabinet, downward, upward, or moving them together, will release the security catch that enables one with a second hand to manipulate handle 12 and open the door. It is essential that handles 13, 14 be operated simultaneously with handle 12 so that the operator must use two hands, one of these hands being larger than that of a child.

Figure 2:
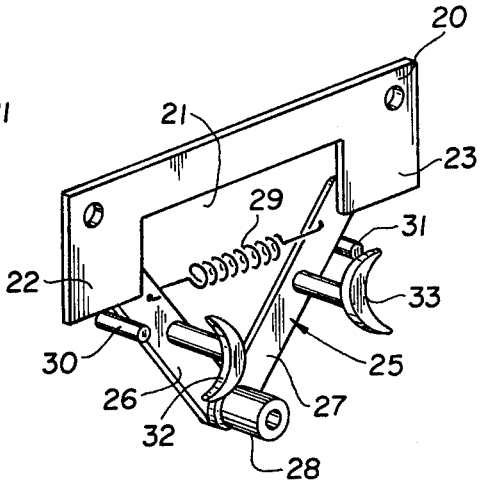
FIG. 2 is a schematic perspective illustration used to demonstrate the principles of the invention when applied to a first embodiment.

FIG. 2 is a perspective schematic of the essential components employed in a first embodiment of the invention. These components include a strike plate 20 and catch means 25. The catch means comprises a pair of arms 26, 27 pivoted about bearing 28 and held in a biased open position by compressed spring 29. Stops 30, 31 limit the extent of the outward positioning of arms 26, 27. Handles 32, 33 are located either directly on members 26, 27, respectively, or are linked thereto,. The separation of these handles in the open state illustrated, must be greater than the hand span of a child and less than the hand span of an adult.

Strike plate 20 is provided with an aperture 21 transversely dimensioned so that the ends of members 26, 27 rest behind legs 22, 23 when in a normally extended position. On the other hand, when contracted by an operator squeezing handles 32, 33 together, these ends will fall within the aperture 21.

These basic components of the invention are installed on and within a standard cabinet structure to achieve the security objectives of the invention. The strike plate 20, or a modification thereof with an orthogonal mounting projection, is installed within the cabinet adjacent to the door aperture. Catch means 25 is installed on the inside edge of the door in proximity to the strike plate. Handles 32, 33 project through the door (as embodied in handles 13, 14 of FIG. 1).

Figure 3:
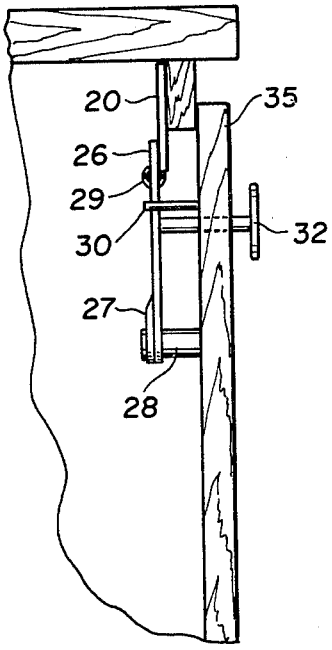
FIG. 3 is a side view of a portion of a cabinet with a closed door having fastening devices in accordance with the first embodiment mounted thereon.

FIG. 3 illustrates such an installation on the upper edge of a door 35. This figure is viewed from the opening side of the door. The means for fastening the invention to the door are not germaine to the invention; however, standard wood screws are appropriate.

Figure 4:
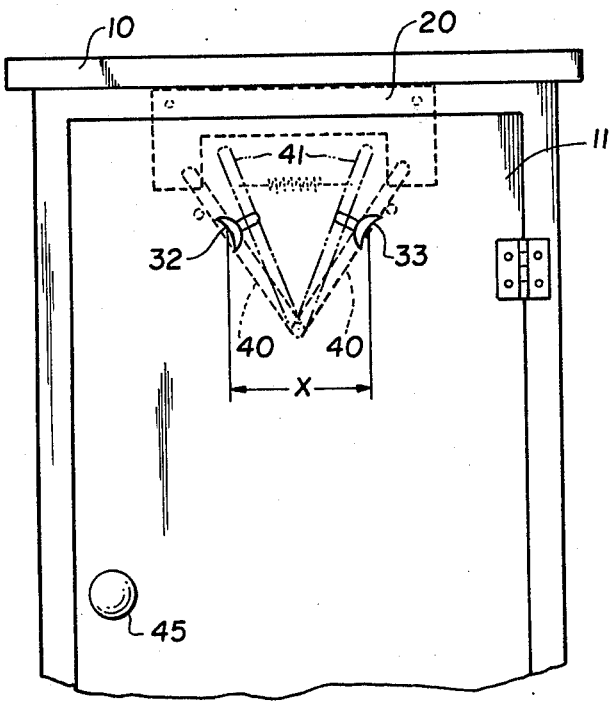
FIG. 4 is a front view of a cabinet door illustrating a phantom outline several positions of the fastening devices in accordance with the first embodiment of the invention.

FIG. 4 shows the extended and contracted positions of the catch of this first embodiment in phantom outline behind a typical door. The static position of the fastener is illustrated by dashed lines 40 and the contracted (released) position of the fastener is illustrated by dashed lines 41. The distance X between handles 32, 33 when at rest, is the aforeprescribed distance greater than a child's hand span but less than an adult's hand span. While FIG. 4 is not drawn to scale, it does include the essential additional handle 45 that effects release of a conventional catch. This handle must simply be positioned elsewhere upon the cabinet face so that it provides for simultaneous actuation by a second hand in order to completely release the door. This second catch should preferably be sufficiently firm to prevent release by pulling on the child-resistant catch alone, or alternatively, the handles on the child-resistant catch should preferably be designed to make it impossible to exert sufficient force to overcome the second catch with the hand operating the child-resistant catch.

Figure 5:
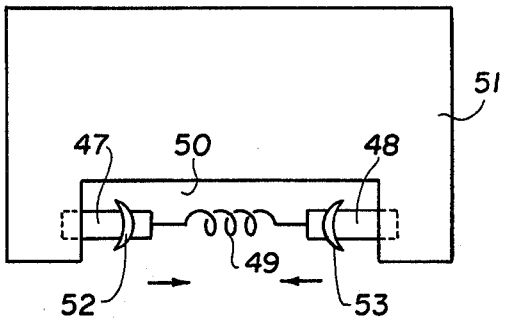
FIG. 5 is a schematic illustration of a second embodiment of the invention.
Figure 6:
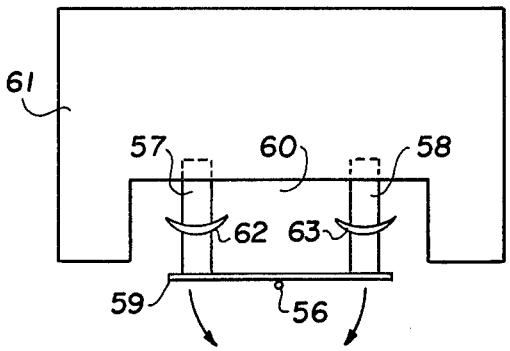
FIG. 6 is a schematic illustration of a third embodiment of the invention.

FIGS. 5 and 6 are schematic illustrations of three additional fastening devices adaptable to use with three other embodiments of the invention. These devices each employ the general principles described in connection with the first embodiment. Namely, they require a strike plate or the like having an aperture that will permit release of a coooperating latch means under certain circumstances. These certain circumstances relate to the physical movement of the latch means; and the physical movement can be effected only by an individual having a hand span greater than that of a child. Furthermore, these fastening devices employ a pair of latching surfaces normally biased to an extended position and compressible to fall within the aperture of the strike plate means by manual actuation of the operator.

FIG. 5 shows latching elements 47, 48 normally biased outwardly by compression spring 49. The outward extension of the latches places them beyond the opening of aperture 50 of strike plate 51. Release buttons or handles 52, 53 on each of the latches, permit contraction against the bias of spring 49 in order to effect release.

In FIG. 6 similar latch means 57, 58 are disposed for engagement within the aperture 60 of a strike plate 61. These latch means are separated by the critical distance which exceeds the hand span of a child yet is within the hand span of an adult. These latch means are biased to an actuated or closed condition by a flat spring 59 secured at point 56. Handles 62, 63 upon the latch means are actuable downwardly against the bias of spring 59 to simultaneously release both latches.

Figure 7:
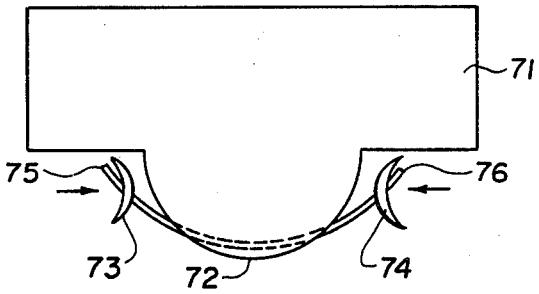
FIG. 7 is a schematic illustration of a fourth embodiment of the invention.

In FIG. 7, the latch means and means for biasing them into engagement with the strike member, are merged into the characteristics of a single resilient element 70. Strike plate 71 has a convex dependent portion 72. The central portion of the element 70 extends behind the strike plate when the door is normally closed. Element 70 has a residual bias to the position illustrated. In order to effect release, this element is distorted by compressing the handles 73, 74 together, bringing the ends 75, 76 together and deflecting the curvature of element 70 until it overrides that of the strike plate.

Figure 8:
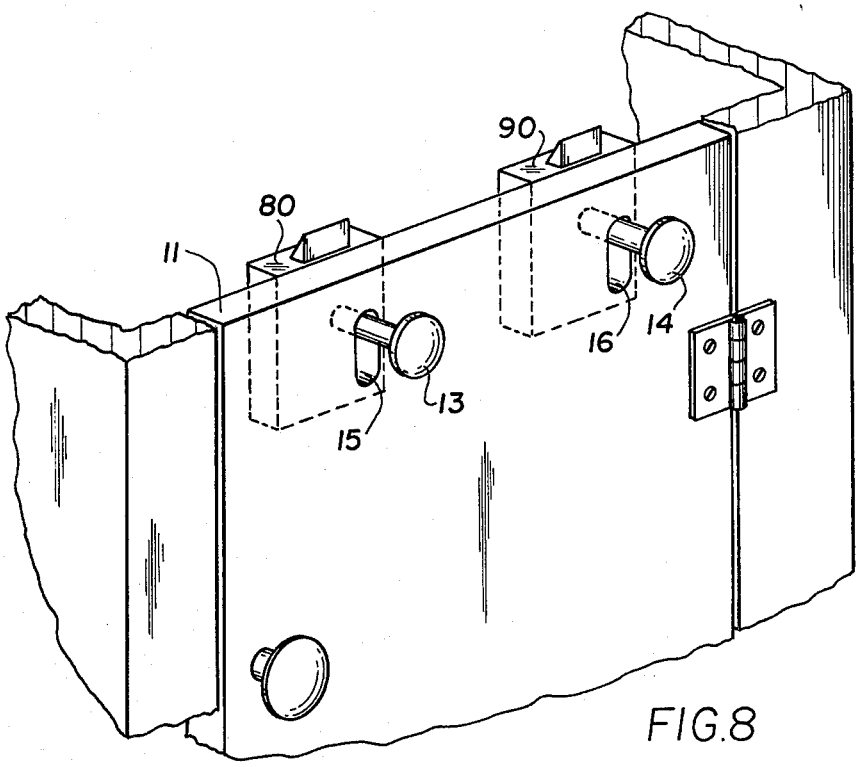
FIG. 8 is a perspective view of a cabinet door having a fifth embodiment of the invention mounted thereon.

A still further embodiment of the invention contemplates the utilization of individual catches 80, 90 as illustrated in FIG. 8. These may be conventional latch devices with means securing them to the inner surface of a cabinet door 11. Knobs 13, 14 project through the door and slots 15, 16 are provided to permit the downward movement of the knobs. As is the common practice, the latch means include individual spring biasing elements which hold the latching members in a normally extended position. Of course, the biasing structure for these latches may also be oriented to effect release when handles 13, 14 are pushed inwardly rather than pulled downward.

A number of preferred embodiments have been described and illustrated. Other modifications will be immediately apparent to those skilled in the art. It is intended to cover all aspects of the invention and any modifications coming within the spirit and teachings thereof should be embraced by the appended claims.

I claim:

1. A child-resistant fastening system for securing a standard door member in closed position over the opening of an associated cabinet comprising: first and second elongated latch means on the inner surface of said door; a single catch means within said cabinet in proximity to one end of each said first and second latch means; each said latch means being pivoted about a common axis at the end remote from engagement with said catch means; common biasing means for holding said latch means into engagement with said catch means when said door is closed; a release means fixed to each latch means between said axis and said one end, each being connected to one of said latch means and extending to the outer surface of said door, said release means being separated by a distance greater than a child's hand span but less than an adult's hand span and being manually operative to overcome said biasing means and effect disengagement of each said latch means from said catch means; and additional means securing said door member in closed position, said additional means being disposed more than one hand span from either of said release means and being manually operative to open said door only when each of said release means are disengaged.

2. A child-resistant fastening system as defined in claim 1 wherein said common biasing means is a spring member normally in expanded state that is compressed to effect disengagement of said catch means by said release means.

* * * * *